US006892504B1

(12) United States Patent
diGirolamo et al.

(10) Patent No.: US 6,892,504 B1
(45) Date of Patent: May 17, 2005

(54) WALL STRUCTURE WITH CORNER CONNECTORS

(75) Inventors: Edward R. diGirolamo, Raleigh, NC (US); Michael L. Torres, Raleigh, NC (US); Robert W. Herrmann, Raleigh, NC (US); Aaron M. Herrmann, Raleigh, NC (US); Thomas C. Boyd, Raleigh, NC (US); Gary Bennett, Macon, NC (US)

(73) Assignee: The Steel Network, Inc., Raleigh, NC (US)

( * ) Notice: Subject to any disclaimer, the term of this patent is extended or adjusted under 35 U.S.C. 154(b) by 0 days.

(21) Appl. No.: 10/413,759

(22) Filed: Apr. 15, 2003

Related U.S. Application Data

(63) Continuation-in-part of application No. 10/058,958, filed on Jan. 28, 2002.

(51) Int. Cl.[7] ..... E04C 2/38

(52) U.S. Cl. ..... 52/657; 52/167.3; 52/651.06; 52/665; 52/695

(58) Field of Search ..... 49/501; 52/656.4, 52/656.9, 690, 695

(56) References Cited

U.S. PATENT DOCUMENTS

| | | | | |
|---|---|---|---|---|
| 2,126,511 | A * | 8/1938 | Soule | 52/223.6 |
| 4,235,054 | A * | 11/1980 | Cable et al. | 52/210 |
| 4,563,851 | A * | 1/1986 | Long | 52/656.1 |
| 5,315,803 | A * | 5/1994 | Turner | 52/739.1 |
| 5,389,778 | A * | 2/1995 | Shinomiya | 52/745.19 |
| 5,505,031 | A * | 4/1996 | Heydon | 52/281 |
| 5,657,606 | A * | 8/1997 | Ressel et al. | 52/690 |
| 6,185,898 | B1 * | 2/2001 | Pratt | 52/657 |
| 6,308,469 | B1 * | 10/2001 | Leung | 52/167.3 |
| 6,460,297 | B1 * | 10/2002 | Bonds et al. | 52/79.1 |
| 6,505,442 | B2 * | 1/2003 | Banicevic et al. | 49/501 |
| 6,679,006 | B2 * | 1/2004 | Banicevic et al. | 49/501 |

* cited by examiner

*Primary Examiner*—Carl D. Friedman
*Assistant Examiner*—Yvonne M. Horton
(74) *Attorney, Agent, or Firm*—Coats & Bennett, P.L.L.C.

(57) ABSTRACT

A wall structure adapted to be fabricated in sections or modules and comprises an upper member, a lower member, a plurality of studs interconnected between the upper and lower members with respective studs including openings therein, and at least one diagonal brace member or strap extending diagonally across the wall structure. In one embodiment the strap is extended to opposed corner areas where opposed end portions of the strap are fastened to a portion of the upper or lower member and to a portion of an adjacent column or stud.

46 Claims, 16 Drawing Sheets

WALL STRUCTURE WITH CORNER CONNECTORS

CROSS-REFERENCE TO RELATED APPLICATION

This is a continuation-in-part of U.S. patent application Ser. No. 10/058,958 filed Jan. 28, 2002.

FIELD OF THE INVENTION

The present invention relates to wall structures and more particularly to wall structures that may be fabricated in sections or modules.

BACKGROUND OF THE INVENTION

It is important in the design of wall structures to provide both lateral strength and lateral rigidity. Lateral strength is required to resist horizontal loads due to, for example, wind and earthquake forces. If the wall structure is properly designed and constructed, components of the wall will transfer these horizontal or shear forces to adjacent elements in the load path such as other wall components, floors or foundations.

Lateral rigidity is required to prevent the floors and roof from excessive side-sway. If the walls are sufficiently rigid, they will prevent floor and roof framing members from moving off their supports. In addition, buildings with sufficient lateral rigidity will suffer less non-structural damage and thereby avoid long-term degradation due to cracking and water infiltration.

It has long been common to brace walls or wall sections in buildings in order to provide some lateral strength and rigidity. Generally, this bracing has been provided through either sheathing secured to the outside of the wall or by straps or braces that extend at a diagonal along the outside of the wall. Such sheathing and diagonal bracing do transfer loads and tend to provide some measure of lateral strength and lateral rigidity in the wall. However, because of the location of the sheathing or the bracing, the loads transferred are transferred eccentrically. This, of course, results in the loads tending to twist the wall structure and its components, and consequently these loads are not directly and concentrically transferred to the foundation or other termination points. In the end, such exterior sheathing and exterior bracing does not efficiently transfer shear loads.

Therefore, there has been and continues to be a need for a wall structure or wall module that is designed to efficiently provide both lateral strength and lateral rigidity through a concentric design.

SUMMARY OF THE INVENTION

The present invention entails a wall structure that comprises a pair of opposed members and at least two columns (studs) extending between the opposed members. At least one strap extends diagonally across the wall structure and includes opposed end portions. The strap is connected to the wall structure by extending the opposed end portions into opposed corner areas of the wall structure. The opposite end portions of the strap is secured to one of the opposed members and to a portion of an adjacent column.

In one particular embodiment, the opposed members of the wall structure include U-shaped tracts. In this embodiment, each end portion of the strap is extended between a portion of a U-shaped tract and an adjacent column and fasteners are extending through a portion of the U-shaped tract, the end portion of the strap, and through an adjacent column so as to sandwich the end portion of the strap between the U-shaped tract and the adjacent column.

In another embodiment of the present invention, the wall structure is provided with at least one diagonal brace that extends through openings formed in a series of studs that form a part of the wall structure. The diagonal brace, which can be rigid or flexible, includes opposite end portions that project into opposed corner areas of the wall structure. Disposed in each corner area is a bracket that is secured to one of the opposed members of the wall structure. Further, the bracket includes an opening therein through which an end portion of the brace extends. Secured to the end of the brace adjacent the bracket is a retainer that effectively retains the end portion of the brace within the bracket and prevents the end portion of the brace from pulling inwardly from the opening in the bracket.

Other objects and advantages of the present invention will become apparent and obvious from a study of the following description and the accompanying drawings which are merely illustrative of such invention.

DESCRIPTION OF AN EXEMPLARY EMBODIMENT

Figure 1:
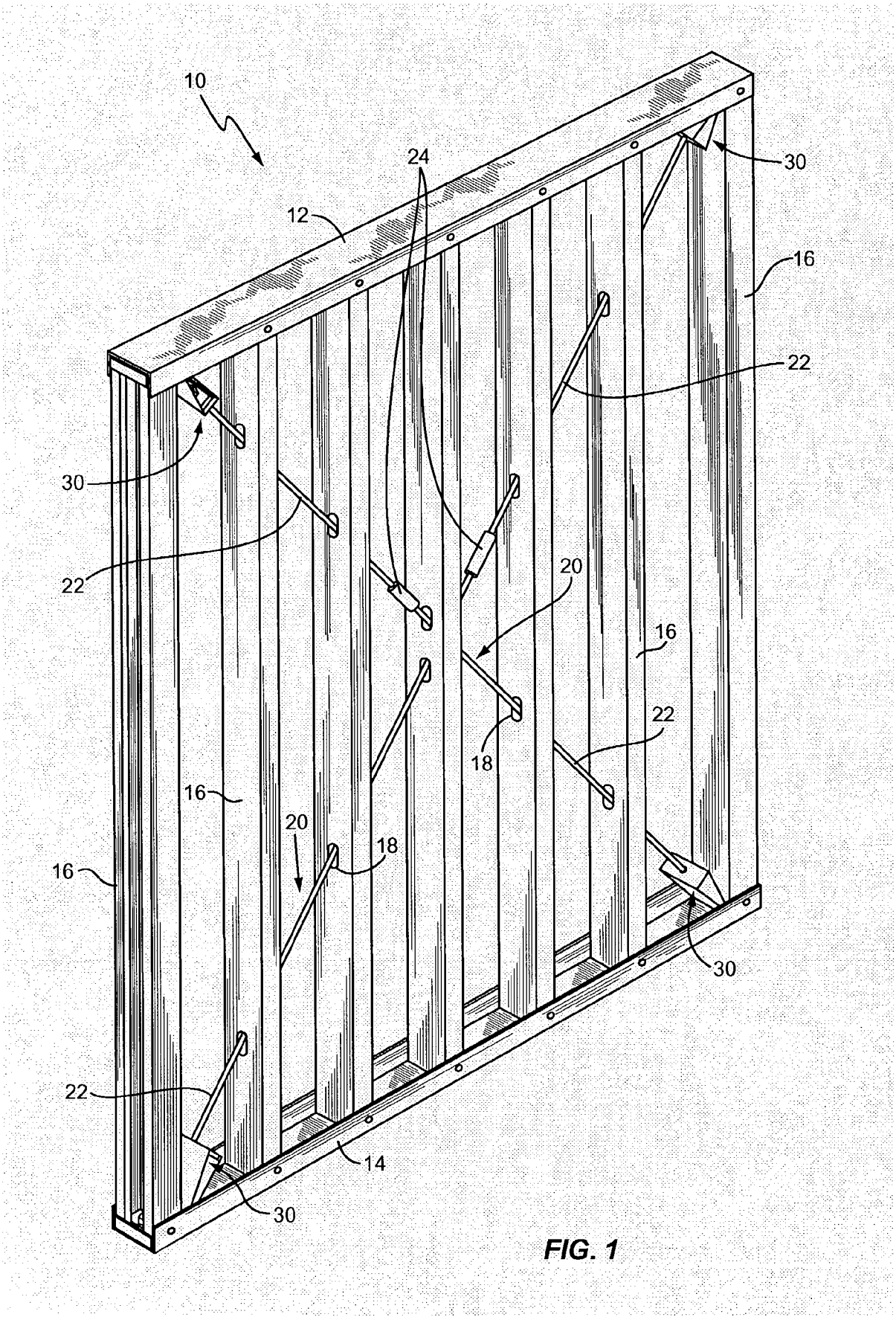
FIG. 1 is a perspective view of the wall structure or wall module of the present invention.

With further reference to the drawings, the wall structure or wall module of the present invention is shown therein and indicated generally by the numeral 10. Wall structure 10 basically comprises an upper member 12 and a lower member 14. Members 12 and 14 may assume various configurations but in one embodiment, upper member 12 and lower member 14 would be of a generally U-shaped channel construction. In the case of the U-shaped channel construction, each member 12 and 14 would include a central or web portion and a pair of upturned, or downturned, as the case may be, flanges.

Secured between the upper member 12 and lower member 14 is a plurality of spaced apart studs 16. The studs are secured to both the upper and lower members 12 and 14. Studs 16 may be secured to the upper and lower members 12 and 14 in any number of ways. For example, fasteners such as screws can be extended through the flanges of the upper and lower members 12 and 14 into the respective studs. In addition, or in the alternative, 90° clips can be used to connect the respective studs to members 12 and 14.

Each stud 16 in the embodiment illustrated is of a channel construction and includes a web and a pair of opposed flanges. Certain studs 16 provided within the wall structure 10 are provided with openings 18 formed in the web portion of the studs. As will be appreciated from subsequent portions of this disclosure, the openings 18 are particularly spaced. For the most part, each of the studs 16 found in the wall structure 10 are of the same basic construction. However, in certain embodiments, the studs positioned on opposite ends of the wall structure 10 may be referred as columns and may be of a slightly different configuration and/or a heavier gauge metal in the case of a metal wall structure. In fact, the ends or columns of the wall module may comprise multiple members.

Figure 2:
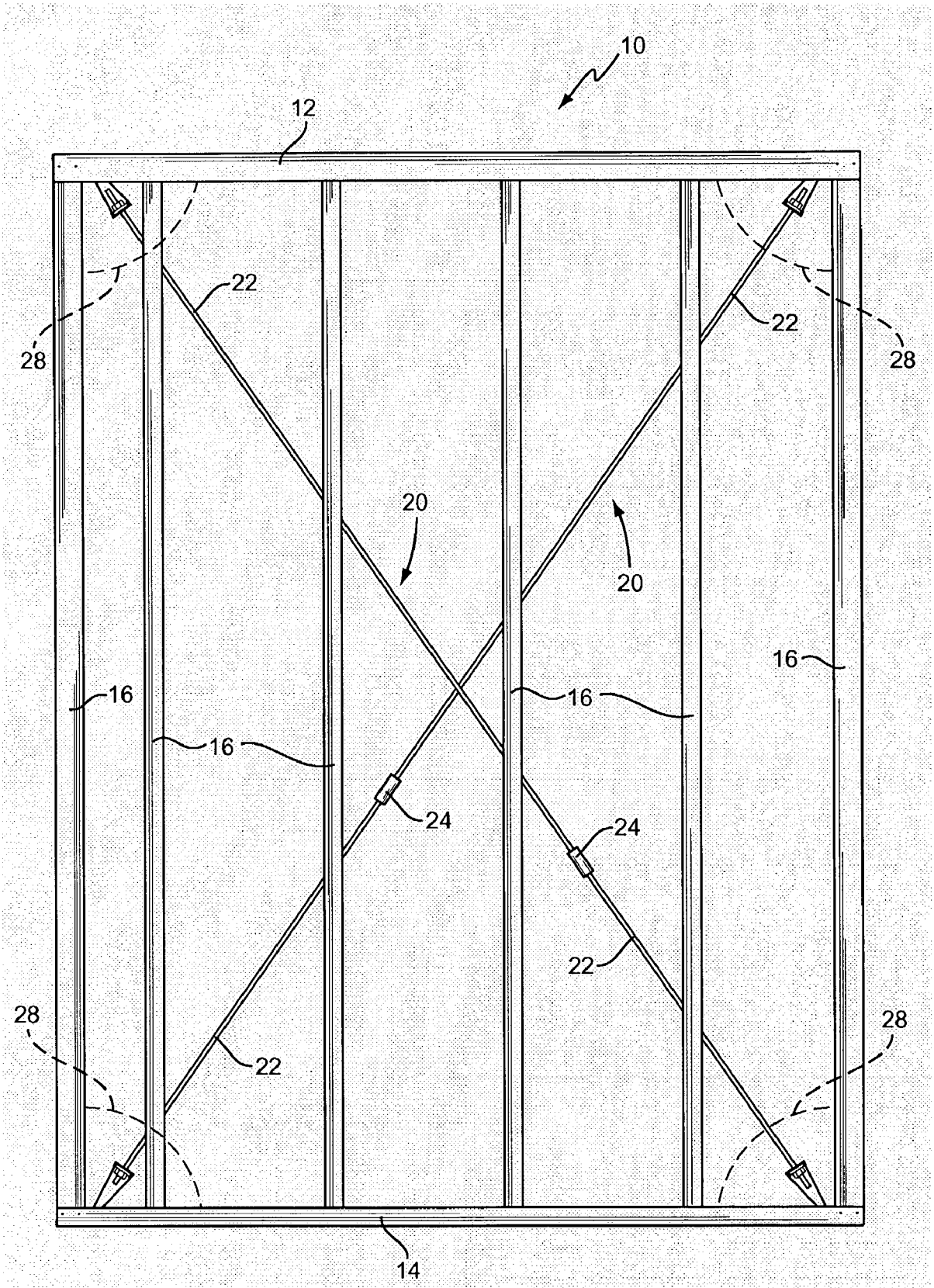
FIG. 2 is a side elevational view of the wall structure of the present invention.

As seen in FIG. 2, the wall structure includes four corner areas 28. The corner areas 28 are denoted by the area enclosed by the dotted lines referred to by the numeral 28. Extending between opposed corner areas are a pair of braces or support members 20. It should be appreciated that it is not required in some wall structures to have both braces or support members 20. In some designs and for some particular applications, a single brace 20 would be sufficient. In any event, as seen in the drawings, each of the braces 20 extend between opposed corner areas 28 of the wall structure.

Braces 20 extend through the openings 18 formed in the studs 16. Consequently, the braces 20 extend through a central plane or a central area of the wall structure 10. Expressed in another way, the wall structure 10 includes opposed sides. Disposed between the opposed sides of the wall structure is a central area that basically lies between the opposed sides. The braces or support members 20 extend diagonally through this central area.

The braces or support members 20 can assume various configurations or designs. For example, the braces 20 may be in the form of shafts, rods, cables or other types of connecting or support structures. In the embodiment illustrated in the drawings, each brace 20 is in the form of a rod or shaft and includes a pair of sections 22 joined together by a threaded coupling or threaded sleeve 24. Formed about each end of each brace 20 is a threaded end 26. However, it may be preferred to provide each diagonal brace as a single member with the opposite ends having left and right hand threads. This means that the single member brace can be secured and tightened into two opposite connectors by turning the single member brace in a single direction.

As discussed above, the wall structure 10 includes four corner areas 28. Each brace 20 extends between opposed corner areas and is effectively connected to opposed corner areas. More particularly, a connector, indicated generally by the numeral 30, is connected to each end portion of each brace 20 and is in turn connected to a corner area 28 of the wall structure. Generally, each connector 30 includes a pair of sections, a first section and a second section. The first section of the connector 30 extends from the end portion of a respective brace 20 towards a connecting point in the wall structure. The second section of the connector 30 actually connects to a portion of the wall structure 10. In terms of the embodiment illustrated in FIGS. 3 and 4, the first section of the connector comprises a generally triangular configuration. The second section of the connector 30 is that section that extends between a stud 16 or an end column and one of the members 12 and 14. As will be explained later, in the embodiment illustrated, the connector 30 comprises two plates that are mated together. In the first section, the plates are spaced apart, and as alluded to above, generally form the triangular configuration. The second section of the connector 30 is where the plates merge together and attach to the wall structure.

Figure 4:
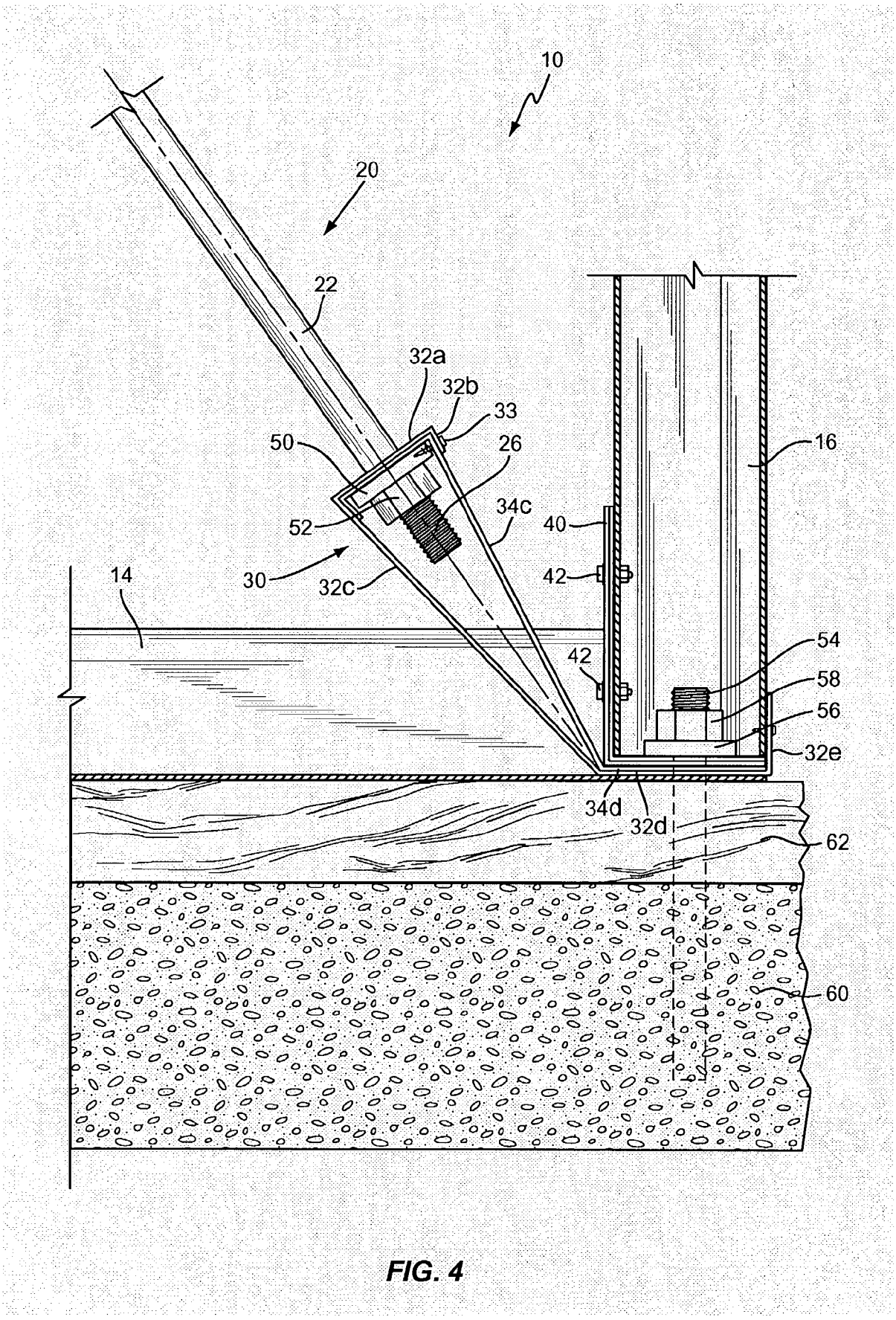
FIG. 4 is a view similar to FIG. 3, but with portions of the structure removed to better illustrate the invention.
Figure 5:
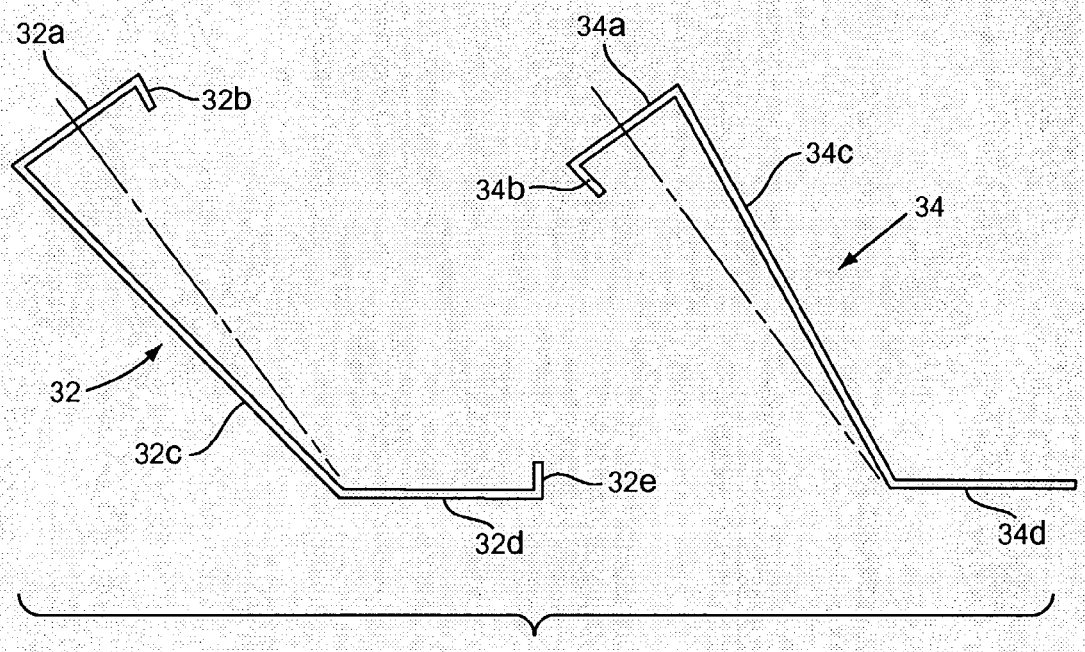
FIG. 5 is a side elevational view of the two plates that are utilized to form a connector in the wall structure.
Figure 6:
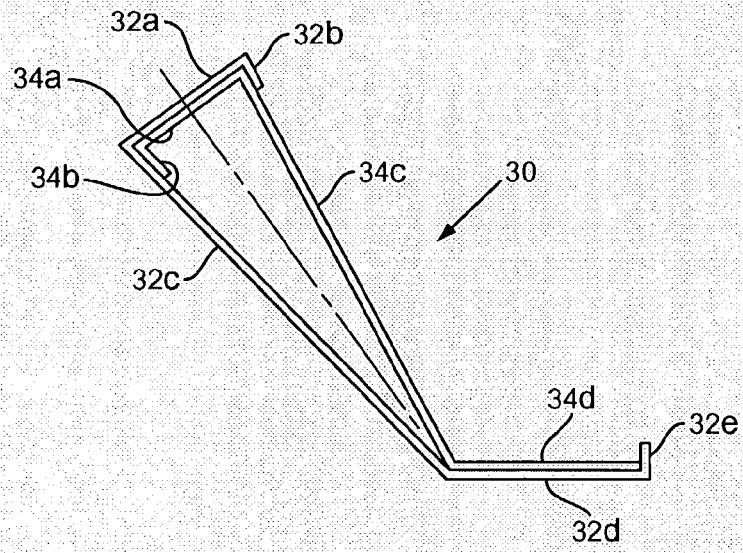
FIG. 6 is a side elevational view of the connector formed by the two plates shown in FIG. 5.

Thus, each connector 30 includes a pair of plates 32 and 34. FIG. 5 shows each of the plates. First, with respect to plate 32, the same includes a cross member 32*a* and a flange 32*b* formed across the cross member 32*a*. Extending from the cross member is a leg 32*c* that bends and forms a tail 32*d*. A flange 32*e* is turned up along the tail 32*d*. Similarly, the second plate, plate 34, includes a cross member 34*a* and a flange 34*b*. Extending from the cross member 34*a* is a leg 34*c* and a tail 34*d*. FIG. 6 shows plates 32 and 34 mated together. In particular, the second plate 34 is effectively inserted into plate 32 such that the legs 32*c* and 34*c* form the triangular configuration with the respective cross members 32*a* and 34*a*. Fasteners 33 extend through the plates 32 and 34 to secure them together. More particularly, as viewed in FIG. 4, the fasteners 33 extend through flange 32*b* and through the leg 34*c* to effectively secure the two plates 32 and 34 together about the section of the connector 30 that extends around the brace or rod 22. As viewed in FIG. 4, the lower ends of the legs 32*c* and 34*c* form an apex where the tail portions 32*d* and 34*d* merge. Flange 32*e* forms the terminal end of the connector 30 and basically turns up and extends past the terminal edge of tail 34*d*.

The cross members 32*a* and 34*b* include an opening that enables an end portion of a respective brace 20 to be extended therethrough. The second or tail section of the connector 30 is designed to be inserted between a stud or end column 16 and one of the members 12 and 14. This is particularly illustrated in FIG. 4. The upper section of the connector 30 as viewed in FIG. 4 is connected to an end portion of the brace or rod 20 by a retainer or nut 52. A spacer bar 50 is interposed between the retainer 52 and the cross member 34*a*. A mounting insert 40 is inserted between the tail section of the connector 30 and the stud or end column 16. In particular, the mounting insert 40 assumes a generally L-shape and is secured by fasteners 42 to a flange or other portion of the stud or end column 16. Also, the flange 32*e* of plate 32 turns up adjacent the lower portion of the stud 16 and is fastened thereto by a screw or other type of fastener. The connector 30 is firmly secured to the wall structure 10 by a bolt or anchor bolt 54 that extends through openings formed in the tail portions 32*d* and 34*d* as well as through openings formed in the mounting insert 40 and the lower member 14.

The connector 30 shown herein is fabricated from sheet metal. It will be understood and appreciated by those skilled in the art that the connector 30 could be a single casting or made from a number of castings.

Figure 3:
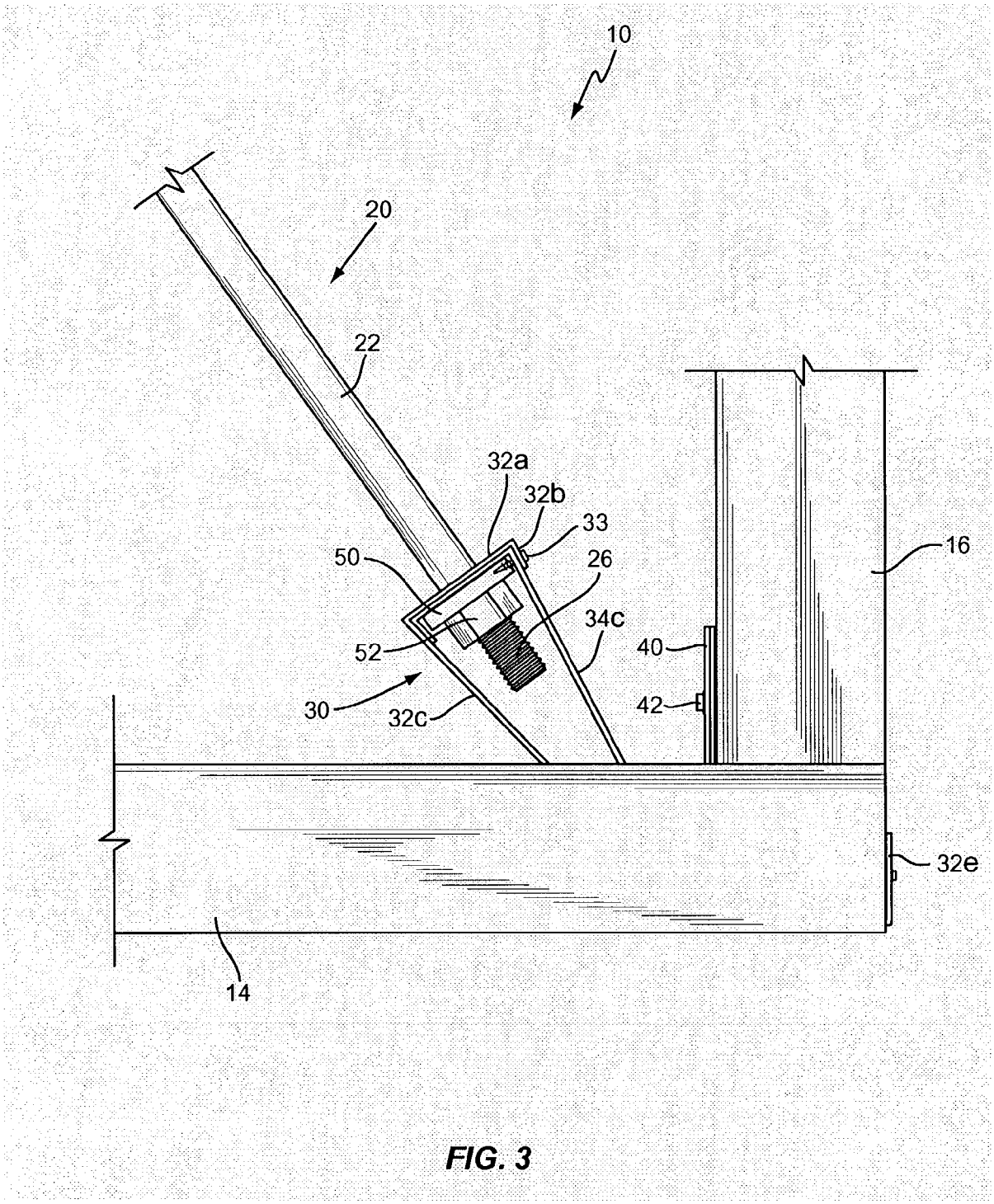
FIG. 3 is a fragmentary side elevational view of a corner portion of the wall structure.
Figure 3A:
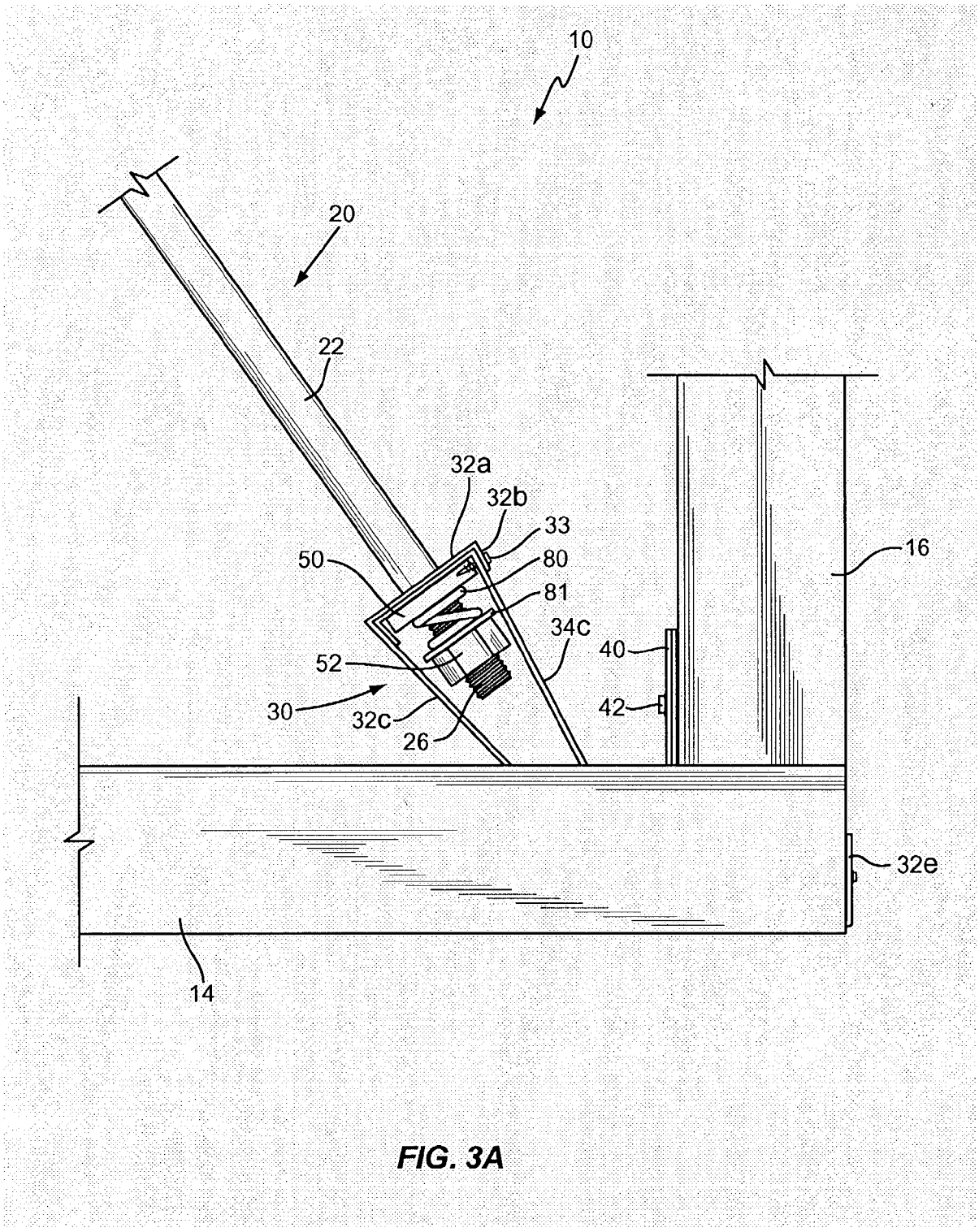
FIG. 3A is a view similar to FIG. 3, but which shows a modified connection between a corner connector and a brace.

FIG. 3A shows a modified form of connecting brace or member 20 to the opposed connectors 30. Here a spring 80 and a washer 81 are interdisposed between the spacer 50 and the nut 52. The strength, characteristics and size of spring 80 is selected so as to maintain the brace or member 20 in tension. For example, as the wall module 10 deforms or tends to deform one of the braces or member 20 may tend to be loosely connected between opposed connectors 30. As shown in FIG. 3A, the spring 80 will expand and effectively place the brace or member 20 in tension. When the wall module 10 assumes a no-load configuration or when the brace 20 is placed in tension, the spring 80 will assume a compressed configuration between the spacer 50 and the nut 52.

The wall structure 10 shown in FIGS. 1 and 2 can be supported in a number of ways. As illustrated in FIG. 4, the wall structure 10 is supported on a sill plate 62 and an underlying foundation 60. Thus, the anchor bolt 54 is extended downwardly through both the sill plate 62 and into the foundation 60. Although a sill plate is shown herein, it will be appreciated that in commercial application or applications that are not based on wood construction, that a sill plate would not be required.

The respective connectors 30 and the braces 20 attached thereto can be securely stationed or fastened within the wall structure by tightening the retainer 52. By tightening the retainer 52, each connector 30 is pulled or urged in an axial direction along the rod or shaft 22 that forms the brace 20. This effectively places the rod or brace 20 in tension.

It is appreciated that the connector 30 such as shown in FIGS. 3 and 4 would be disposed about the opposed corner areas 28 of the wall structure 10. Such a connector 30 would be anchored or secured within the wall structure in essentially the same manner as shown in FIG. 4. Connectors 30 disposed about the upper corner areas of the wall structure may be anchored or secured into various overlying structure. However, still the second or tail section of the connectors 30 would generally be anchored the same way. That is, they would extend between the upper member 12 and a stud or end column 16. In this case, the anchor bolt 54 might extend upwardly into a stiffener, a roof joist or even a concrete floor section. Those skilled in the art will appreciate that the corner areas of the wall structure 10 can be secured or anchored to many different types of overhead or underlying building constructions. In multi-story construction, the wall modules 10 can be vertically aligned. In particular, individual wall modules 10 can sandwich intervening floor sections with the upper member 12 of one wall module lying underneath and aligned with the lower member 14 of another wall module.

Figure 8:
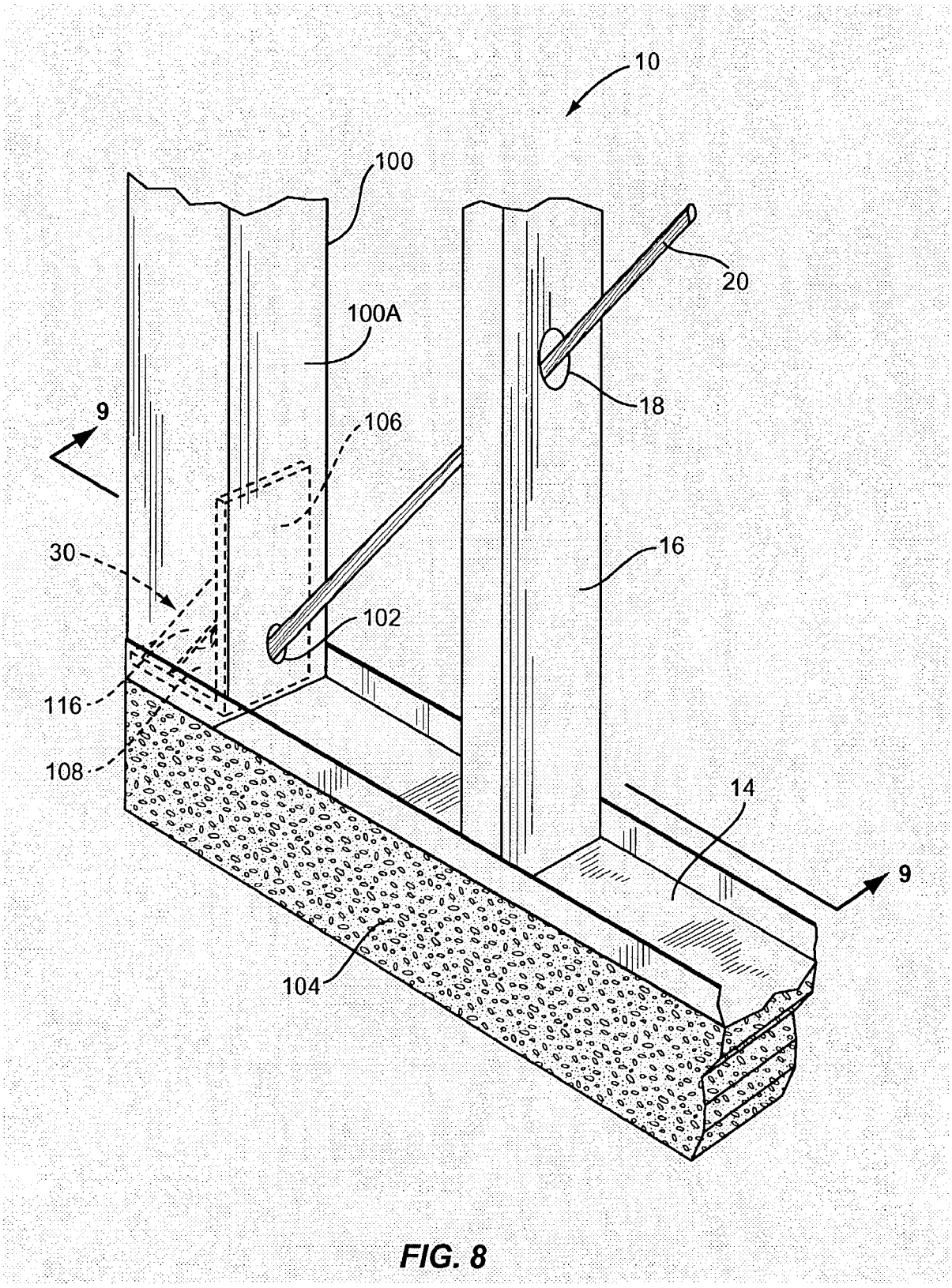
FIG. 8 is a fragmentary perspective view of an alternate embodiment for the connector that connects the diagonal brace to a corner area of the wall structure.
Figure 9:
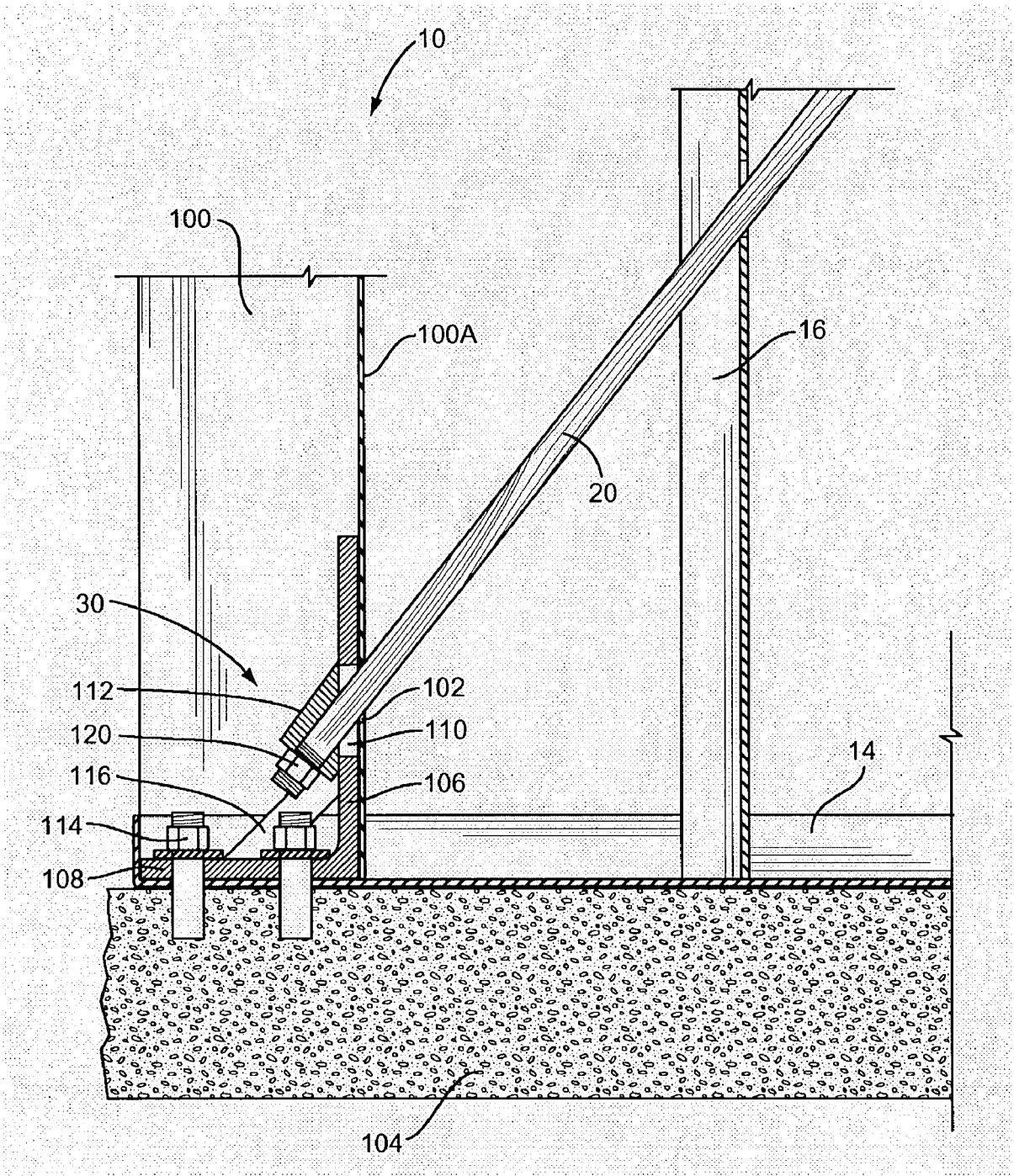
FIG. 9 is a sectional view taken through the line 9—9 of FIG. 8.

Turning to FIGS. 8 and 9 an alternative embodiment for the wall structure 10 is shown therein. Basically, the embodiment of FIGS. 8 and 9 discloses a different connector 30 for securing or anchoring opposed end portions of the diagonal brace 20. As viewed in FIGS. 8 and 9 the lower member or tract 14 rests on an underlying support structure 104 such as a concrete floor. Extending upwardly from a corner area of the wall structure 10 is a column 100. As noted before, the term "column" is used interchangeably with the tern "stud" and basically means an upstanding support structure within a wall construction. In the case of the embodiment shown in FIGS. 8 and 9, column 100 is shown to be somewhat larger than the adjacent stud 16. Column 100 is open on one side and includes an inward face or inward side 100A. Further, the column includes an opening 102 (FIG. 8) through which an end portion of the brace 20 extends.

Viewing the connector 30 of FIGS. 8 and 9 in more detail, it is seen that the same basically comprises an L-shape bracket. The L-shape bracket includes a vertical plate 106 and a horizontal plate 108. Note that the bracket is disposed within the column 100 and in the case of the embodiment shown in FIGS. 8 and 9, the L-shaped bracket is positioned such that the vertical plate 106 lies flush against the inside of the inward face 100A. Horizontal plate 108 on the other hand lies flush against the web of the lower member of tract 14.

Vertical plate 106 includes an elongated opening 110 that permits an end portion of the brace 20 to extend therethrough. This is best illustrated in FIG. 9. In addition, secured to the vertical plate 106 about the opening 110 is a stop 112. As viewed in FIG. 9, stop 112 projects diagonally downwardly from the opening 110 formed in the vertical plate 106. In this design, the stop 112 effectively forms a sleeve or an opening through which the end portion of the brace 20 can project.

As illustrated in FIG. 9, the terminal end of the brace 20 is threaded. A retainer 120 in the form of a nut is screwed onto the threaded end of brace 20. Retainer or nut 120 is tightened against the lower end portion of the stop 112. Retainer or nut 120 by abutting against the stock 112 prevents the brace 20, as viewed in FIG. 9, from moving from the bracket in a generally left to right direction. That is, the cooperation of the retainer 120 and the stop 112 prevents the brace 20 from pulling inwardly out of engagement with a bracket.

It follows that a like structure would be formed about the opposed corner of the wall structure 10. Consequently, by tightening the nuts or retainers 120 about opposite ends of the brace 20, the brace is secured within the wall structure and held, at least in a no load situation, in tension.

To provide additional support to the L-shaped bracket, there is provided a diagonal member 116 on each side of the bracket. More particularly, as illustrated in FIGS. 8 and 9, there is provided on each side of the L-shaped bracket a diagonal member 116 that extends between the vertical plate 106 and the horizontal plate 108.

To secure the bracket within the wall structure 110, there is provided a pair of bolt-type fasteners 114 (FIG. 9). These bolts fasteners extend downwardly through the lower member 14 and are anchored into the underlying structure or floor 104.

Figure 10:
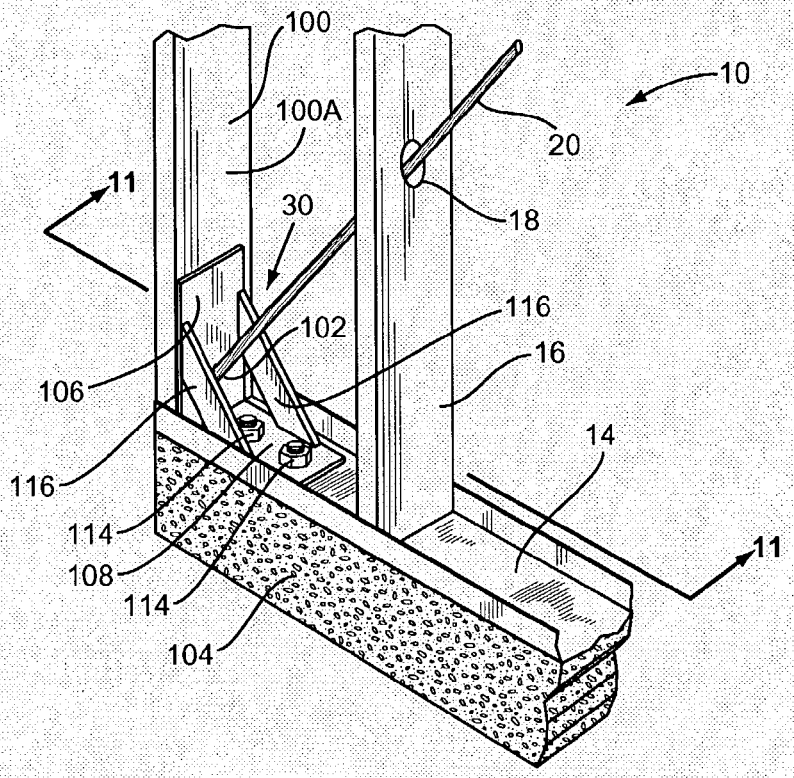
FIG. 10 is a fragmentary perspective view of another alternate embodiment for the connector that connects the diagonal brace to a corner area of the wall structure.
Figure 11:
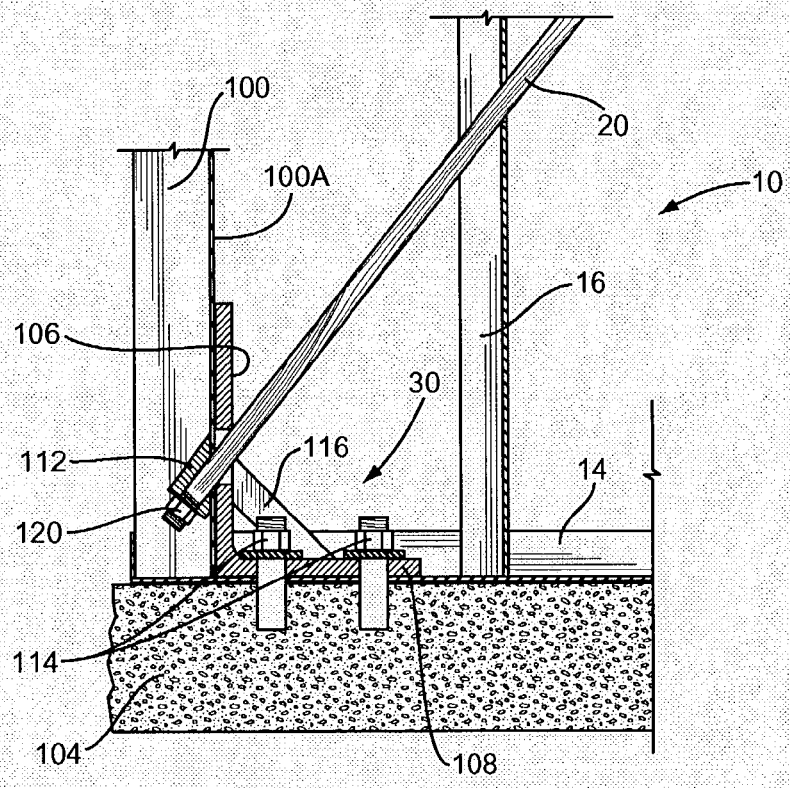
FIG. 11 is a sectional view taken through the line 11—11 of FIG. 10.

Turning now to FIGS. 10 and 11, an alternative design for the connector 30 is shown therein. Connector 30, as illustrated in FIGS. 10 and 11, is similar to the connector shown in FIGS. 8 and 9. The basic difference is that the connector 30 is disposed exteriorly of the column 100. More particularly, the L-shaped bracket structure comprised of plates 106 and 108, as viewed in FIG. 9, has been reversed and secured adjacent the outside of web 100A. Structurally, the connector 30, shown in FIGS. 10 and 11, is virtually identical to the connector 30 shown in FIGS. 8 and 9. As just eluded to, the basic difference is that the L-shaped bracket has been re-oriented to lie outside of the adjacent column 100.

Figure 12:
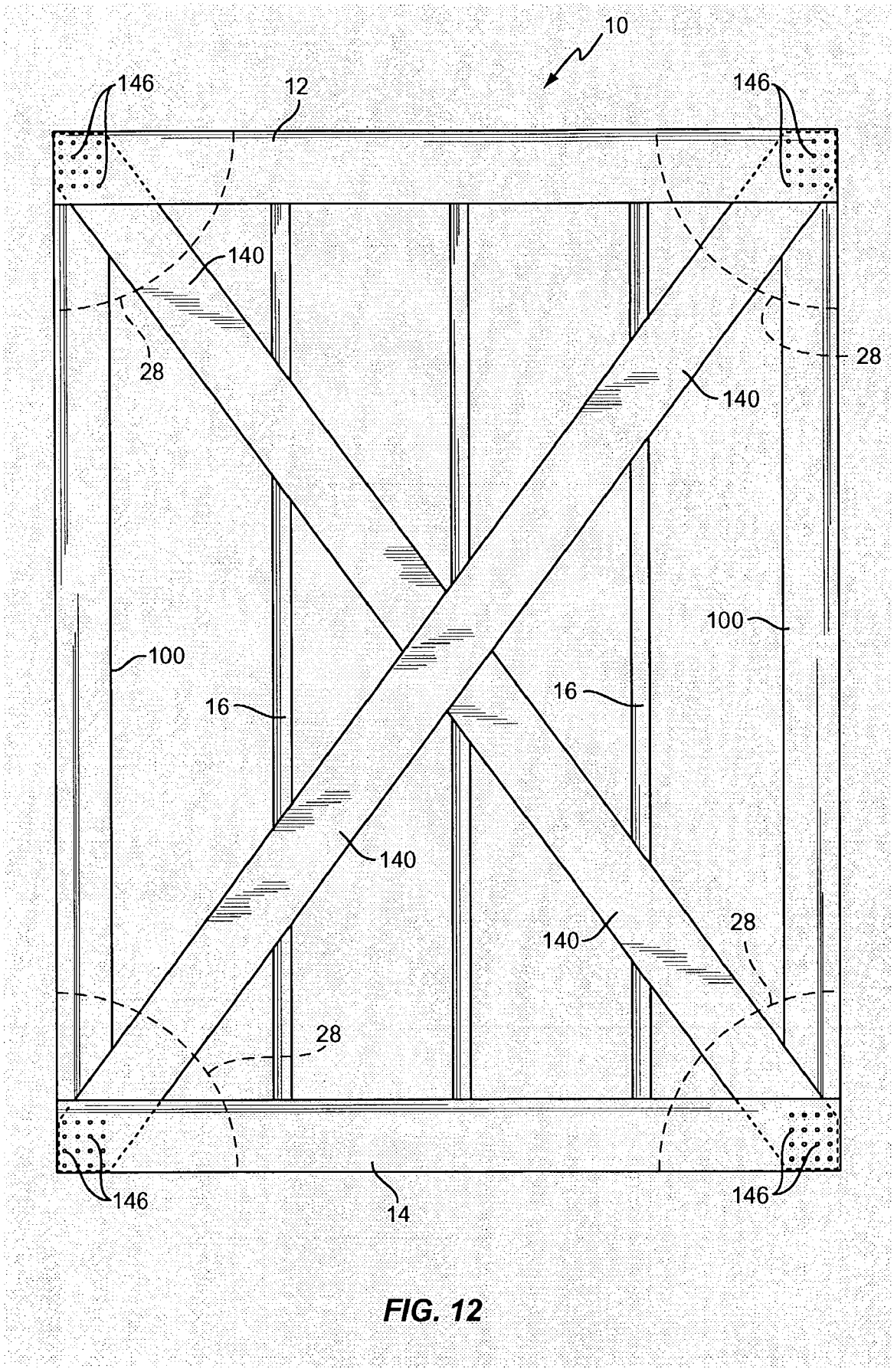
FIG. 12 is an elevational view of an alternate embodiment for the wall structure where the wall structure includes at least one diagonal strap.
Figure 13:
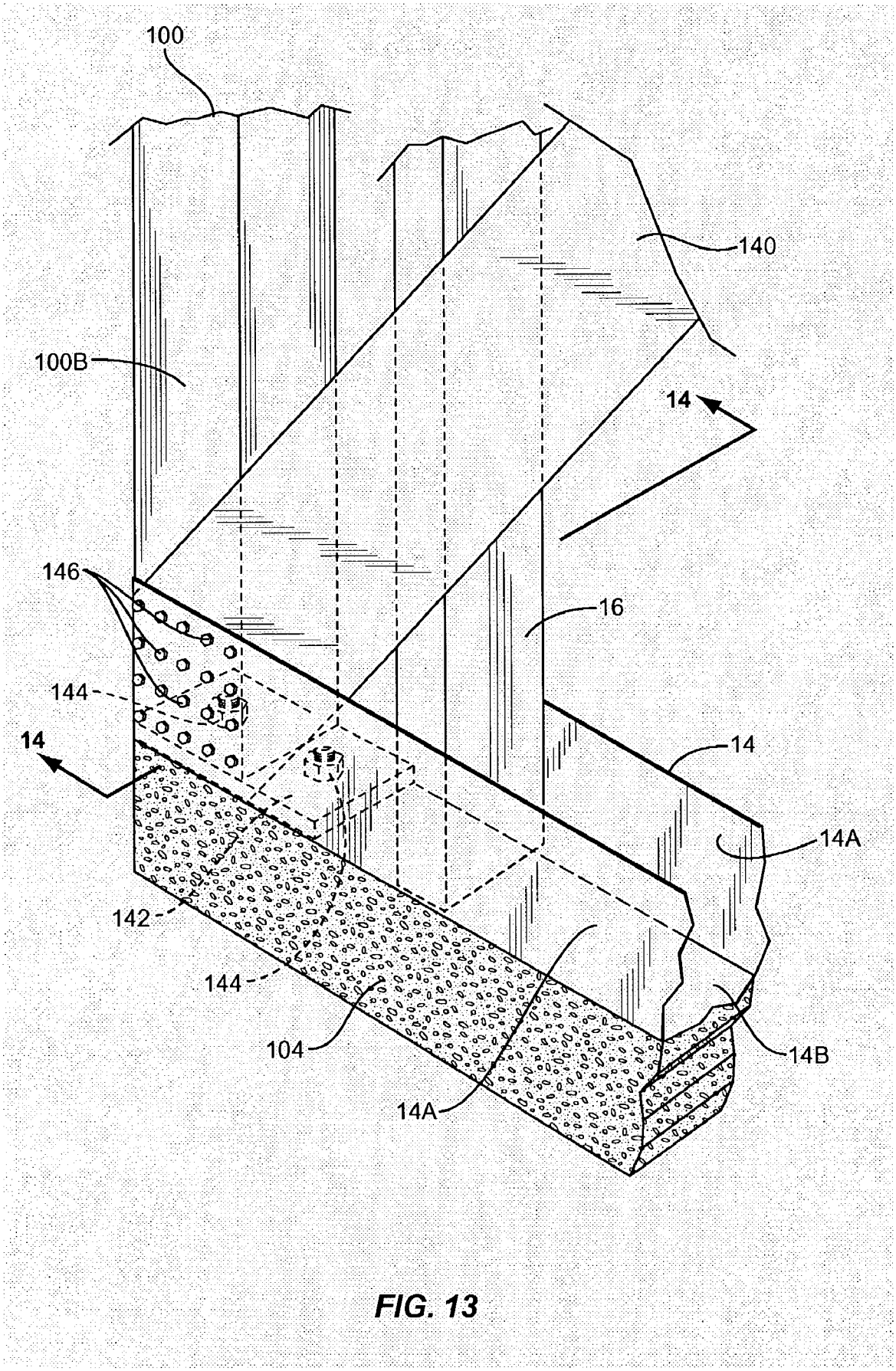
FIG. 13 is a fragmentary perspective view of a corner area of the wall structure shown in FIG. 12 and particularly illustrating how one end portion of the strap is secured within the wall structure.
Figure 14:
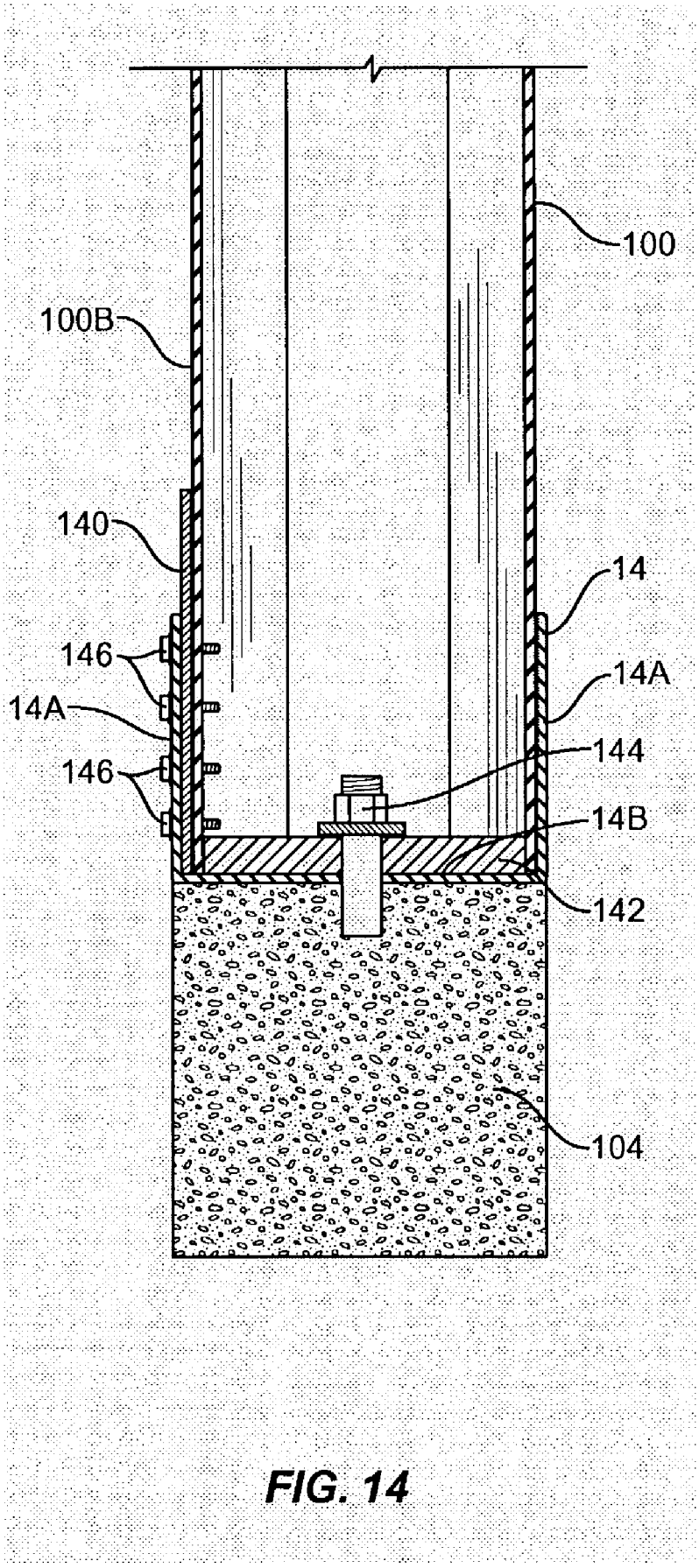
FIG. 14 is a cross-sectional view taken through the line 14—14 of FIG. 13.

Another embodiment for the wall structure 10 is shown in FIGS. 12–14. In this case, the basic construction of the wall structure remains the same with the exception that there is provided a pair of diagonal straps 140 that extends across one side of the wall structure 10. Straps 140 would preferably be of a metal construction and would extend from one corner area 28 to an opposed corner area 28. Note that the straps 140, as contrasted with the diagonal braces 20, are disposed outwardly of the respective studs 16 or columns 100.

Each strap 140 includes opposed end portions. The opposed end portions of the straps 140 are extended into the corner areas 28 of the wall structure such that the end portions lie between a portion of one of the columns 100 and a portion of the upper or lower members 12 and 14. More particularly, and with reference to FIGS. 11 and 12, note that the lower member or tract 14 includes a pair of flanges 14A and a web 14B. In this case, the outer end portion of strap 140 is extended between the flange 14A and the side 100B of the column 100. Once positioned between the column 100 and the flange 14A, a series of fasteners 146 such as screws are extended through the flange 14A, through the end portion of the strap 140 and into and through the side 100B of the column 100. This securely ties and fixes the strap 140 about this particular corner area. Structurally, the end portion of the strap 140 is secured to both the upper tract 12 or lower tract 14, and a portion of the column 100.

To provide additional strength and connecting integrity, the column 100 is supported on a reinforcing plate 142. The reinforcing plate 142 includes one or more openings and one or more fasteners 144 that project downwardly through the reinforcing plate 142, through the web 14B of the lower tract 14 and into the underlying support structure 104.

It is appreciated that the wall structure may not require two diagonal straps 140. In some applications, one single diagonal strap 140 may be sufficient. In any event, the manner of connecting the end portions of the strap 140 with the other components of the wall structure at both opposed corners would be as shown in FIGS. 13 and 14 and as described above.

Figure 15:
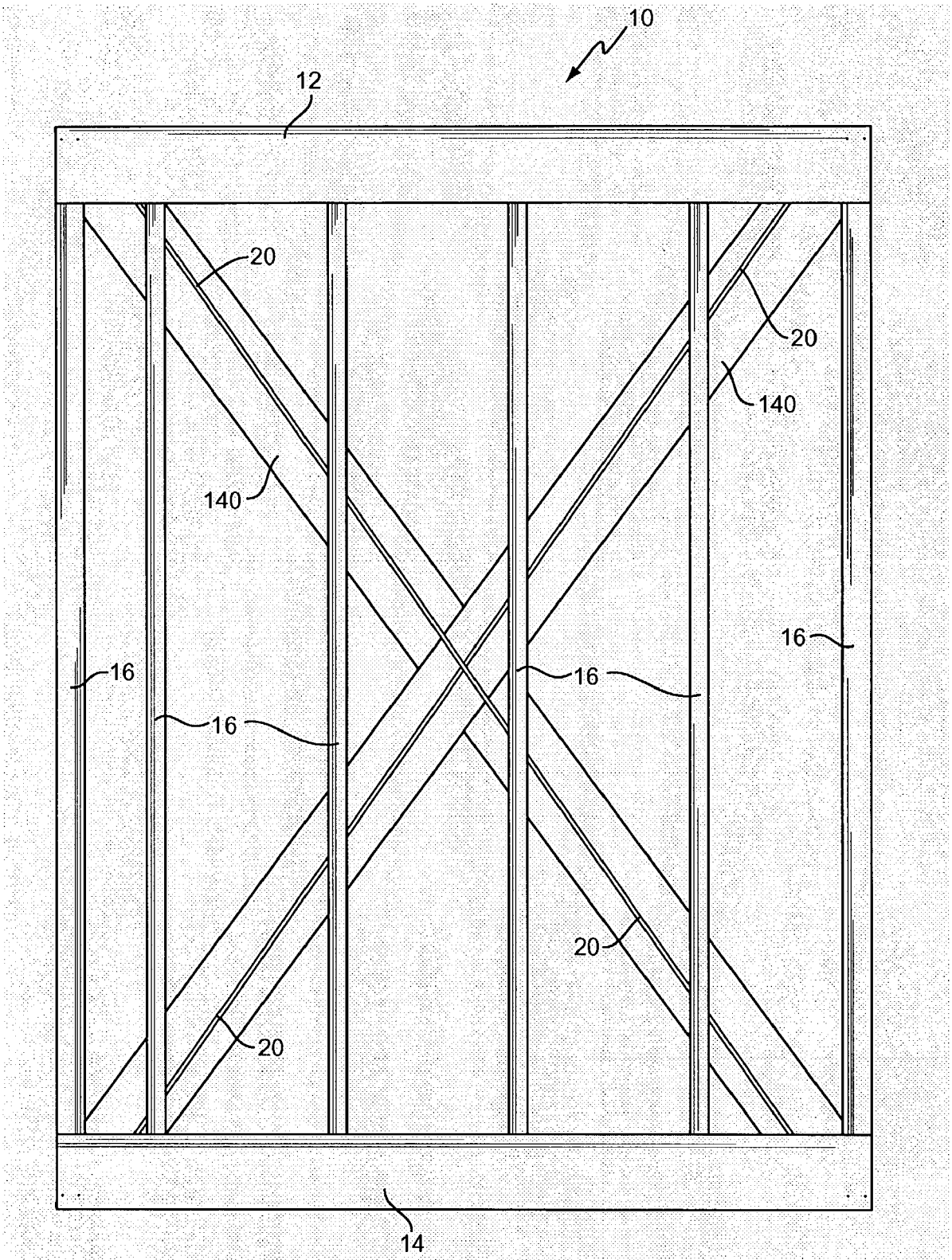
FIG. 15 is an elevational view of an alternate embodiment of the wall structure where the wall structure includes at least one diagonal strap and at least one diagonal brace.

An alternative design for the wall structure 10 is shown in FIG. 15. Wall structure 10, as disclosed in FIG. 15, includes the diagonal straps 140 described above and shown in FIGS. 12–15 and the diagonal braces 20 discussed above and shown in FIGS. 1–11. Both the diagonal straps 140 and the diagonal braces 20 are secured in the corner areas of the wall structure 10 as described above. The combination of the diagonal straps 140 and the diagonal braces 20 provide for an increase in load capacity that is particularly useful in mid-rise buildings.

Figure 16:
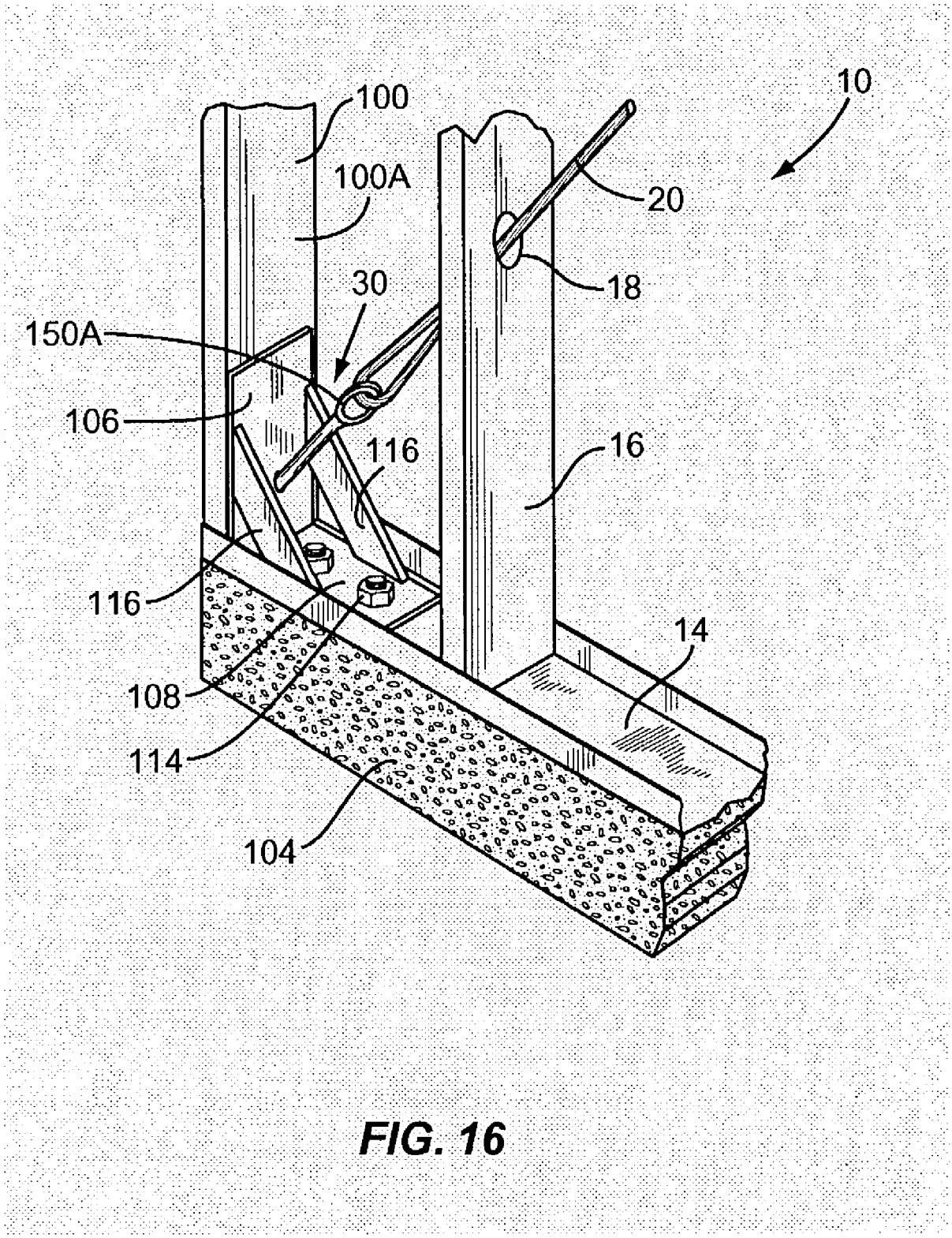
FIG. 16 is a fragmentary perspective view of an alternative embodiment for the connector that connects a diagonal brace in the form of a cable to the corner area of the wall structure.

FIG. 16 shows an alternative wall structure 10 and connector 30. In this case, the wall structure 10 is provided with one cable 20 or a pair of diagonal cables 20. To secure the cable 20 in corner areas of the wall structure 10, there is provided a cable connector 150 that extends through plate 106 and through the web 100A of the adjacent column 100. Cable connector 150 includes an eyelet 150A that receives a terminal end of the cable 20. In the case of the embodiment illustrated in FIG. 16, the terminal end of the cable 20 is presented in the form of a loop that is threaded through the eyelet 150A. Cable connector 150 can be secured within the corner structure of the wall 10 in various ways. However, it is contemplated that in one embodiment, cable connector 150 would be secured in the same manner as the brace 20 shown, for example, in FIGS. 10 and 11. More particularly, the terminal end of the cable connector 150 could be threaded and provided with a securing nut that would engage a stop that extends from the inside of the web 100A, again in the same manner as illustrated in FIG. 11. It is appreciated that the L-shaped bracket comprised of plates 106 and 108 would be of the same basic structure as described above with respect to FIGS. 10 and 11. Therefore, a detailed discussion of this structure is not required.

Figure 17:
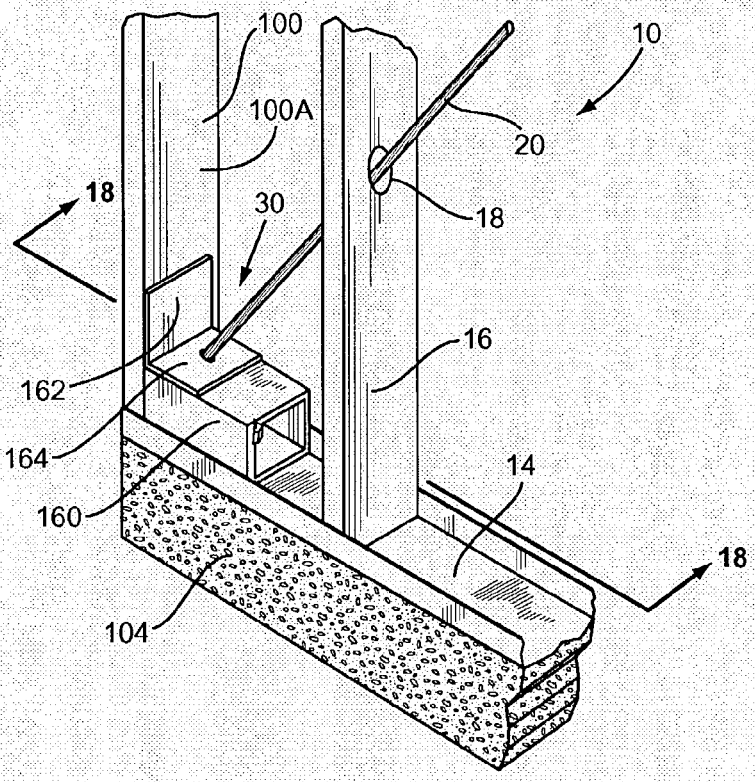
FIG. 17 is a fragmentary perspective view of an alternate embodiment for the connector that connects the diagonal brace to a corner area of the wall structure.
Figure 18:
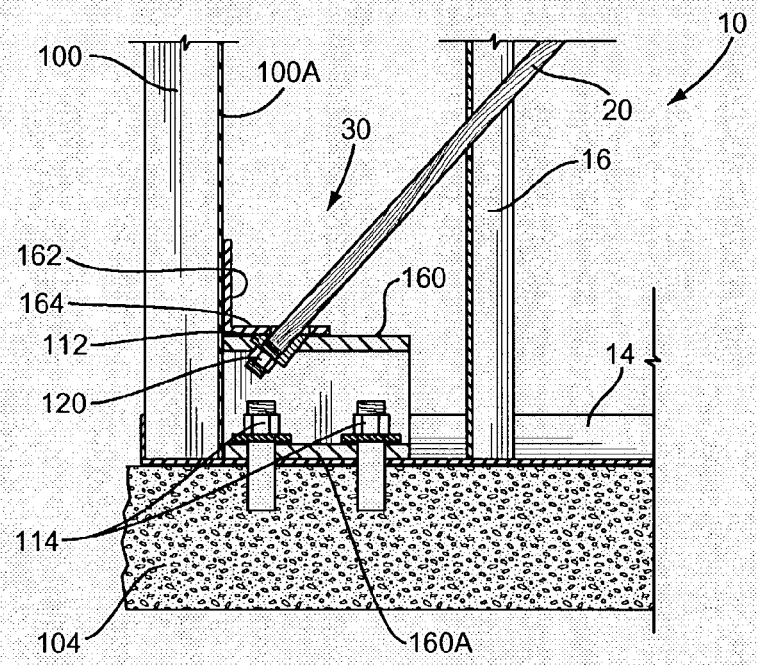
FIG. 18 is a sectional view taken along the line 18—18 of FIG. 17.

Turning to FIGS. 17 and 18, another alternate design for a wall structure 10 and connector 30 is shown. In this embodiment, one or more diagonal braces 20 are utilized. The connector structure 30 includes a box channel 160. Note that box channel 160 is disposed within the track 14 and one end of the box channel 160 is disposed flush against the web 100A of column 100. Box channel 160 includes a base plate 160A that lies adjacent the lower track 14. Secured to the top of box channel 160 is an L-shaped bracket that includes plates 162 and 164. The L-shaped bracket is secured to both the box channel 160 and the web 100A by weldment or other suitable means such as bolts or screws. An opening is formed in both the plate 164 and the top of the box channel 160. These openings enable the terminal end of diagonal brace 20 to project therethrough. Like other embodiments discussed above, there is provided a stop 112 that is formed on the inner side of the top of box channel 160. This is shown in FIG. 18. A nut 120 is secured to the threaded end of the brace 20. Nut 120 will engage stop 112 to prevent the brace 20 from inadvertently pulling from the box channel 160.

Figure 7:
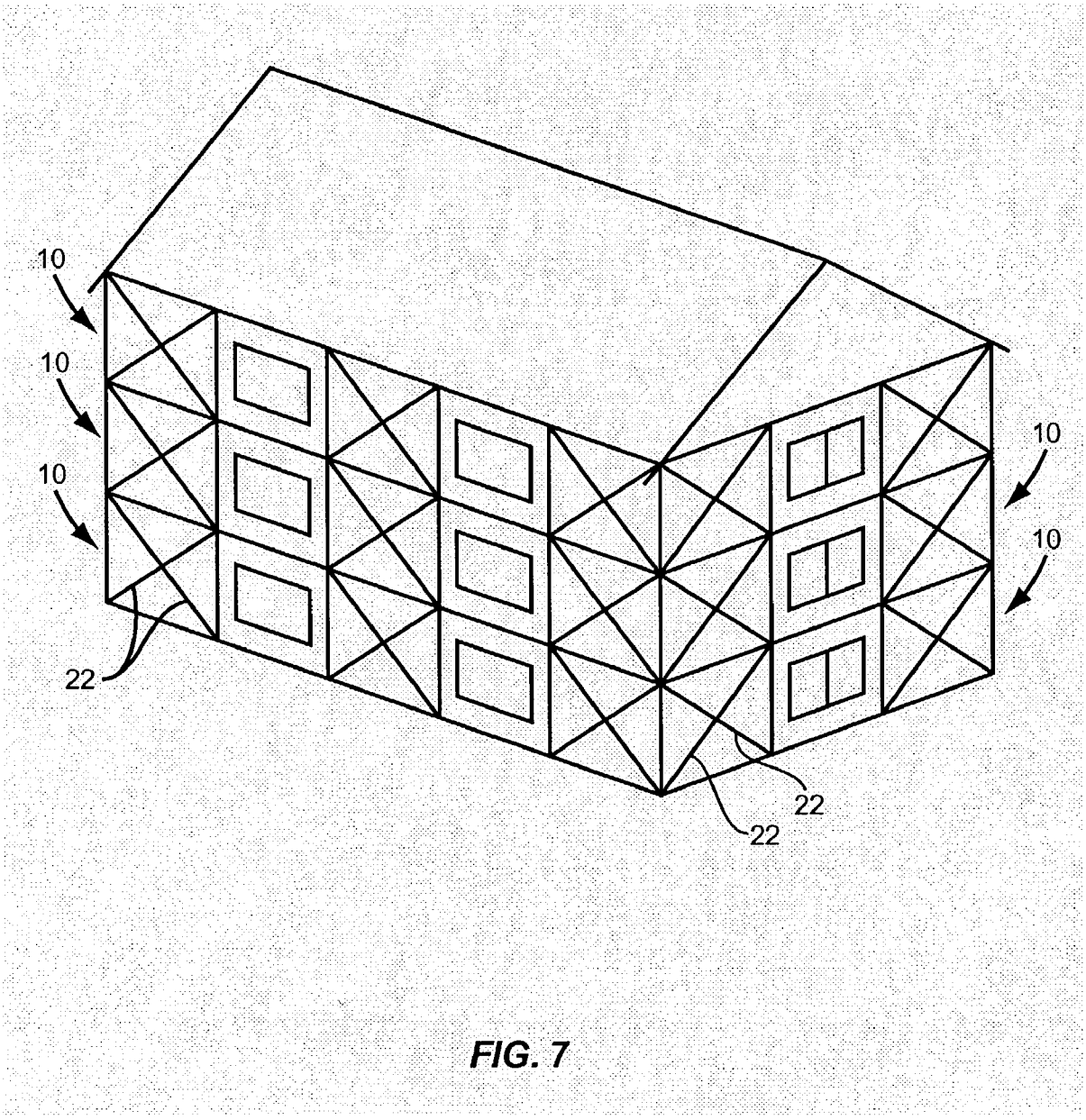
FIG. 7 is a perspective view illustrating how the wall structure or wall module of the present invention could be incorporated into a multistory structure.

The wall structure 10 of the present invention may be constructed of various components and materials. In one embodiment, it is contemplated that the wall structure would be of a basic metal construction. FIG. 7 is a schematic illustration of how the wall structure 10 could typically be utilized in a multistory structure. Note that the wall structures or modules are vertically aligned from the foundation to the roof. Further note that the wall structures or modules 10 are ideally equal in width and height and are located symmetrically throughout the exterior walls of the building. In some cases, exterior walls cannot provide sufficient rigidity and strength throughout a building. In these cases, it may be important to provide that rigidity and strength through interior walls. Consequently, the wall structure or module 10 of the present invention can be incorporated into interior walls. In particular, the wall structures or modules can be used within interior walls when the allowable span to width ratio for the roof diaphragm is exceeded.

From the foregoing specification and discussion, it is appreciated that the wall structure or modules 10 of the present invention can be constructed of various heights and widths. Once constructed in the fashion described, the wall structures or modules are inherently rigid and strong. Further, the wall structure or module 10 has the capacity to efficiently transfer shear loads to selected points in the wall structure such as to both upper and lower termination points. Thus, in the case of a shear load applied horizontally from the left, as viewed in FIG. 2, such shear loading will tend to result in the loads being transferred to the bottom corners of the wall structure 10. In this case, the lower right corner of the wall structure would be in compression while the lower left portion of the wall structure would be in tension. Also, because the braces or supports 20 are concentrically disposed within the wall structure itself, these shear forces or lateral loads are transferred in a concentric fashion throughout the wall structure. This avoids the drawbacks and problems that occur when the loads are transferred eccentrically.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

What is claimed is:

1. A corner connecting assembly for a metal wall, comprising:

a. a U-shaped channel extending across a portion of the metal wall;

b. a column extending generally normal with respect to the U-shaped channel;

c. a strap extending diagonally with respect to the U-shaped channel and the column;

d. the strap including an end portion disposed adjacent a portion of the U-shaped channel and adjacent a portion of the column;

e. fasteners extending through the U-shaped column, the end portion of the strap, and the U-shaped channel; and f. a brace extending diagonally with respect to the U-shaped channel and the column and wherein the brace includes an end portion disposed adjacent a portion of the U-shaped channel and adjacent a portion of the column and which projects through an opening in the column.

2. The corner connecting assembly of claim 1 wherein the end portion of the strap is disposed between the column and the U-shaped channel such that the end portion of the strap is sandwiched therebetween.

3. The corner connecting assembly of claim 1 including a reinforcing plate interposed between the column and the U-shaped channel.

4. The corner connecting assembly of claim 1 wherein the connecting assembly forms a part of a metal wall structure.

5. The metal wall structure and corner connecting assembly of claim 4 wherein the metal wall structure includes four corner areas and wherein one connector assembly is disposed at each of the four corner areas of the metal wall structure.

6. The metal wall structure and corner connecting assembly of claim 5 wherein the metal wall structure includes a pair of the U-shaped channels with the U-shaped channels being disposed along upper and lower portions of the metal wall structure; and the metal wall structure includes two of the diagonal straps, with the two diagonal straps extending between opposed corners of the metal wall structure.

7. The corner connecting assembly of claim 1 wherein the end portion of the brace is secured within the column.

8. The corner connecting assembly of claim 1 including a pair of diagonal braces and a pair of diagonal straps and wherein the diagonal straps cross and the diagonal braces cross.

9. A metal wall structure comprising:

a. an upper U-shaped channel track;

b. a lower U-shaped channel track;

c. a pair of end columns extending between the upper and lower tracks;

d. a series of spaced apart studs disposed between the columns and extending between the upper and lower tracks;

e. a pair of straps extending diagonally across the wall structure, each strap including opposed end portions;

f. the wall structure including four corner areas and wherein one end portion of each strap extends into one of the corner areas;

g. each end portion of one of the straps being disposed adjacent a portion of one column and a portion of one track;

h. a series of fasteners extending through each end portion of the straps and into and through adjacent portions of one column and one track so as to secure the opposed end portions of the straps in the four corner areas to portions of the columns and tracks; and i. a pair of braces extending diagonally across the wall structure through one or more openings in the studs with each brace including opposed end portions.

10. The metal wall structure of claim 9 wherein the end portions of the straps are disposed between a portion of one of the columns and a portion of one of the tracks such that the end portions of the straps are effectively sandwiched between the columns and the tracks.

11. The metal wall structure of claim 10 wherein each U-shaped channel track includes a pair of opposed flanges and wherein the end portions of the straps are sandwiched between the flanges of the tracks and the columns.

12. The metal wall structure of claim 9 wherein the straps extend along at least one side of the wall structure and wherein the braces extend through the wall structure interiorly of the straps.

13. A method of reinforcing a metal wall structure having a pair of end columns extending between two tracks and a series of studs disposed between the end columns and extending between the upper and lower tracks, the method comprising:

a. extending a pair of metal straps diagonally across the metal wall structure;

b. positioning opposite end portions of each strap between a column and one of the tracks;

c. fastening the end portion of each strap to an adjacent portion of a column and an adjacent portion of a track such that each end portion of each strap is sandwiched between a portion of a column and a portion of a track; and d. extending a pair of braces diagonally across the metal wall structure and projecting opposite ends of each brace into one column of the wall structure.

14. The method of claim 13 including positioning a reinforcing plate between each end of each column and an adjacent track.

15. The method of claim 13 wherein each column includes at least three sides and wherein the columns are spaced inwardly of the straps.

16. The method of claim 13 wherein each track is of a U-shape configuration and includes a pair of opposed flanges and wherein each column is set within the tracks such that the flanges are disposed outwardly of the column, and wherein the end portions of each of the straps extend between a flange of one of the tracks and a portion of one of the columns such that the end portion of each strap is sandwiched between one flange of one of the tracks and one of the columns.

17. The method of claim 13 including extending a pair of braces diagonally across the metal wall structure.

18. The method of claim 17 including projecting opposite end portions of each brace into one column of the wall structure.

19. The method of claim 13 wherein the straps are positioned on one side of the wall structure and the braces are positioned interiorly of the straps.

20. A metal wall structure, comprising:

a. a pair of opposed members;

b. two columns secured between the opposed members;

c. a series of spaced apart studs disposed between the two columns and extending between the opposed members, each of the studs including an opening therein;

d. at least one brace extending diagonally across the metal wall structure and extending through the openings in the studs, the brace including opposed end portions;

e. at least one bracket mounted adjacent one of the columns in a corner area of the wall structure; and f. wherein at least one end portion of the brace extends through both the column and the bracket and is secured therein against movement in at least one direction.

21. The metal wall structure of claim 20 wherein the bracket is mounted on the outside of the adjacent column.

22. The metal wall structure of claim 20 wherein the end portion of the brace includes a retainer for preventing the end portions of the brace from being disengaged with the column and bracket.

23. The metal wall structure of claim 22 wherein the retainer abuts against a portion of the bracket.

24. The metal wall structure of claim 21 wherein the bracket assumes an L-shape; and wherein there is provided a fastener for securing the bracket to one of the opposed members.

25. The metal wall structure of claim 20 wherein both the column and the adjacent bracket include an opening therein for receiving an end portion of the brace.

26. The metal wall structure of claim 20 wherein the bracket disposed adjacent the column is of an L-shaped configuration and includes a vertical plate and a horizontal plate, and wherein the bracket further includes a diagonal reinforcing member that extends between the two plates.

27. The metal wall structure of claim 20 including a retainer secured to the end portion of the brace, and wherein the bracket includes a stop for engaging the retainer.

28. The metal wall structure of claim 27 wherein the stop forms an opening through which a portion of the brace extends therethrough.

29. The metal wall structure of claim 28 wherein the bracket assumes an L-shape and includes a vertical plate and a horizontal plate and wherein the vertical plate includes an opening therein and wherein the stop extends from the opening in the vertical plate.

30. The metal wall structure of claim 20 wherein there is provided a bracket disposed in opposed corner areas of the wall structure and wherein opposite end portions of the brace extend through openings formed in the brackets.

31. The metal wall structure of claim 30 wherein there is provided a retainer on each end portion of the brace and wherein the retainer prevents the brace from moving in at least one direction through each bracket.

32. The metal wall structure of claim 31 wherein each bracket is of an L-shape and includes a vertical plate and a horizontal plate and wherein the opening within each bracket for permitting the brace to extend therethrough is formed in the vertical plate.

33. The wall structure of claim 31 wherein each bracket includes a stop for engaging the retainer secured to an end portion of the brace.

34. A wall structure comprising: a pair of opposed members; a series of spaced part studs extending between the opposed members; openings formed in a plurality of the studs; at least one diagonal brace extending through the openings of the studs and extending between opposed corner areas of the wall structure, the diagonal brace including opposed ends; a connector attached to opposite end portions of the brace, each connector being secured to a corner area of the wall structure; the connector including a bracket mounted in one corner area of the wall structure and secured to one of the opposed members; and wherein one end portion of the brace projects through an opening in one of the brackets and wherein there is provided a retainer associated with the end portion of the brace for preventing the end portion of the brace from moving inwardly from the opening in the bracket.

35. The wall structure of claim 34 wherein each bracket is of a generally L-shape and includes a vertical plate and a horizontal plate.

36. The wall structure of claim 35 wherein each bracket includes at least one diagonal member extending between the vertical and horizontal plates.

37. The wall structure of claim 34 wherein the bracket assumes a generally L-shape and includes a vertical plate and a horizontal plate with the vertical plate having the opening therein, and wherein there is provided a stop that extends from the opening in the vertical plate, the stop adapted to engage the retainer secured to one end portion of the brace.

38. The wall structure of claim 34 wherein the brace is a rigid member.

39. The wall structure of claim 34 wherein each bracket is mounted adjacent a stud that is disposed about one end of the wall structure.

40. The wall structure of claim 39 wherein each bracket includes a portion that rests against the adjacent stud.

41. The wall structure of claim 34 including at least one diagonal strap extending across the wall structure.

42. The wall structure of claim 41 wherein the brace is disposed interiorly of the strap and extends through one or more openings formed in the studs.

43. The wall structure of claim 34 wherein there is provided a pair of diagonal braces and wherein there is provided a pair of diagonal straps with the straps being secured across one side of the wall structure and the braces being secured interiorly of the straps.

44. The wall structure of claim 34 wherein the bracket includes a box channel secured in a corner area for receiving one end portion of the brace.

45. The wall structure of claim 44 further including an L-shaped plate mounted adjacent the box channel and wherein one end portion of the brace extends through the L-shaped plate and the box channel.

46. A corner connecting assembly for a metal wall, comprising:

a. a U-shaped channel extending across a portion of the metal wall;

b. a column extending generally normal with respect to the U-shaped channel;

c. a strap extending diagonally with respect to the U-shaped channel and the column;

d. the strap including an end portion disposed adjacent a portion of the U-shaped channel and adjacent a portion of the column;

e. fasteners extending through the U-shaped column, the end portion of the strap, and the U-shaped channel; and f. a pair of diagonal braces and a pair of diagonal straps and wherein the diagonal straps cross and the diagonal braces cross.

* * * * *